US008160480B2

(12) United States Patent
Mochizuki

(10) Patent No.: US 8,160,480 B2
(45) Date of Patent: Apr. 17, 2012

(54) IMAGE FORMING APPARATUS HAVING CONTROLLED SPEED DIFFERENTIAL BETWEEN IMAGE BEARING MEMBERS AND INTERMEDIATE TRANSFER BELT

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 12/429,975

(22) Filed: Apr. 24, 2009

(65) Prior Publication Data

US 2009/0269104 A1 Oct. 29, 2009

(30) Foreign Application Priority Data

Apr. 24, 2008 (JP) ..... 2008-113903

(51) Int. Cl.
*G03G 15/00* (2006.01)

(52) U.S. Cl. ..... 399/167; 399/66; 399/302; 399/308

(58) Field of Classification Search ..... 399/66, 399/167, 302, 308
See application file for complete search history.

(56) References Cited

U.S. PATENT DOCUMENTS

| | | | | |
|---|---|---|---|---|
| 2003/0095815 | A1* | 5/2003 | Nakagawa et al. | 399/299 |
| 2005/0123325 | A1* | 6/2005 | Yamane et al. | 399/297 |
| 2006/0222418 | A1* | 10/2006 | Ebara et al. | 399/301 |
| 2007/0292170 | A1* | 12/2007 | Yoshioka | 399/302 |

FOREIGN PATENT DOCUMENTS

| | | | |
|---|---|---|---|
| JP | 11338274 | A * | 12/1999 |
| JP | 2001-183888 | | 7/2001 |
| JP | 2001-249519 | | 9/2001 |
| JP | 2001282015 | A * | 10/2001 |
| JP | 2004-117426 | | 4/2004 |
| JP | 2005-62642 | | 3/2005 |
| JP | 2005266269 | A * | 9/2005 |
| JP | 2006-267705 | | 10/2006 |

OTHER PUBLICATIONS

English Abstract of JP2001282015A to Takada.*
English Abstract of JP11338274A to Mizutani et al.*
English Abstract of JP2005266269A to Maruta et al.*

* cited by examiner

*Primary Examiner* — Ryan Walsh
(74) *Attorney, Agent, or Firm* — Canon USA Inc IP Division

(57) ABSTRACT

An image forming apparatus includes first and second rotatable image bearing members, a rotatable belt member which can abut on the first and second image bearing members, a drive mechanism to attach or separate the second image bearing member to or from the belt member, a rotation drive mechanism, and a controller controlling a rotational speed of the second image beating member so that the second image bearing member rotates with a predetermined circumferential speed difference with respect to the belt member at least when image formation is performed by the second image bearing member. When the second image bearing member abuts on or separates from the belt member, the controller controls the rotational speed of the second image bearing member so that a circumferential speed difference between rotational speeds of the second image bearing member and the belt member is smaller than the predetermined circumferential speed difference.

8 Claims, 9 Drawing Sheets

FIG.6

| | DRUM FAST ROTATION SYSTEM | BELT FAST ROTATION SYSTEM |
|---|---|---|
| FULL COLOR → BLACK SINGLE COLOR (SEPARATION) | MODE (1) | MODE (3) |
| BLACK SINGLE COLOR → FULL COLOR (ABUTMENT) | MODE (2) | MODE (4) |

IMAGE FORMING APPARATUS HAVING CONTROLLED SPEED DIFFERENTIAL BETWEEN IMAGE BEARING MEMBERS AND INTERMEDIATE TRANSFER BELT

BACKGROUND OF THE INVENTION

1. Field of the Invention

The present invention relates to an image forming apparatus such as a copying machine and a printer which use an electrophotographic process or electrostatic recording process. More specifically, the present invention relates to an image forming apparatus that includes an intermediate transfer member and a recording material bearing member as a rotatable belt member disposed adjacent to an image bearing member on whose surface a toner image is formed, and the belt members can abut on and separate from the image bearing member.

2. Description of the Related Art

Conventionally, a color image forming apparatus capable of forming full-color images which uses a direct transfer method or an intermediate transfer method has been known. In the direct transfer method, a toner image formed on a single or a plurality of photosensitive drums which are image bearing members is transferred to a recording material borne on a revolving belt member, ("transfer belt" hereinafter) as a recording material bearing member. In the intermediate transfer method, a toner image formed on a single or a plurality of photosensitive drums is transferred on a rotatable belt member as an intermediate transfer member ("intermediate transfer belt" hereinafter). Then, the toner image on the intermediate transfer belt is transferred to the recording material. The intermediate transfer method can easily form images on various recording materials and enhance recording material selectivity.

Further, a configuration where circumferential speeds of the intermediate transfer belt and the transfer belt are varied relative to the photosensitive drum has been known as an effective method for improving transfer efficiency. Japanese Patent Application Laid-Open No. 2006-267705 discusses a technique to improve the transfer efficiency by weakening an adhesive force of a toner image formed on a photosensitive drum by applying a shearing force thereto caused by rubbing with an intermediate transfer belt.

In the color image forming apparatus, an image of only a black single color may be formed on the photosensitive drum (i.e., one image bearing member). In this case, a problem arises that when an image bearing member other than that for black is driven, the image bearing member and other related members maybe worn. To deal with this problem, Japanese Patent Application Laid-Open Nos. 2001-249519, 2004-117426, and 2005-62642 discuss a configuration where an image bearing member other than that for black separates from a transfer belt or an intermediate transfer belt during formation of only a black image.

FIG. 9 illustrates a configuration of a conventional image forming apparatus which uses the intermediate transfer method. Four process units that are image forming units are provided corresponding to respective colors of yellow, magenta, cyan and black. The image forming apparatus includes photosensitive drums 1*a* to 1*d*, charge units 2*a* to 2*d*, exposure units 3*a* to 3*d*, development units 4*a* to 4*d*, an intermediate transfer belt 51, a tension roller 52, primary transfer members 53*a* to 53*d*, a drive roller 55, cleaning units 6*a* to 6*d*, and secondary transfer units 56 and 57.

When a full-color image is formed, the charge units 2*a* to 2*d* uniformly charge the photosensitive drums 1*a* to 1*d*, and then the exposure units 3*a* to 3*d* perform exposure according to an image signal and electrostatic latent images are formed on the photosensitive drums 1*a* to 1*d*. The development units 4*a* to 4*d* develop toner images. The toner images on the photosensitive drums 1*a* to 1*d* are sequentially transferred to the intermediate transfer belt 51 by applying transfer biases to the primary transfer members 53*a* to 53*d* from a high voltage power source for transfer (not shown). In this case, by setting a roller for regulating a position of the intermediate transfer belt at a position 58*a* (broken line), the intermediate transfer belt abuts on the four-color photosensitive drums (arrangement illustrated with the broken line). The cleaning units 6*a* to 6*d* collect the toner remaining on the photosensitive drums 1*a* to 1*d* after transfer. The images which are transferred sequentially from the respective photosensitive drums and overlaid to the intermediate transfer belt 51 in the aforementioned manner are transferred to a recording material P by a secondary transfer bias applied between the secondary transfer materials 56 and 57. The toner images transferred to the recording material P are fixed by a fixing unit (not shown) to obtain a full-color image.

When a black single color image is formed, the roller for regulating the position of the intermediate transfer belt is set in a position 58*b* to separate the photosensitive drums 1*a*, 1*b* and 1*c* for forming yellow, magenta and cyan images. The intermediate transfer belt is accordingly disposed as indicated by a solid line in the drawing. Thus the black single color image is formed on the photosensitive drum 1*d*, and transferred by the primary transfer member 53*d* to obtain the single color image. The photosensitive drums 1*a*, 1*b* and 1*c* for other three colors are stopped to prevent wearing.

However, during an imaging operation or imaging preparation where a black toner image is formed, a color mode may switch between a black single color mode and a full-color mode. When the photosensitive drum rotating at a circumferential speed which is greatly different from that of the intermediate transfer belt is separated from the belt member such as the intermediate transfer belt, a belt driving load changes and a shock transmitted to the belt member increases. Consequently, uneven rotation of the belt member caused by the shock affects an image during the imaging operation or the imaging preparation. A similar problem occurs when the intermediate transfer belt abuts on the belt member.

To prevent such a defective image caused by shocks to the belt member, Japanese Patent Application Laid-Open No. 2001-183888 discusses an apparatus which includes a delay circuit for outputting image data after the secondary transfer member abuts and fluctuation in intermediate transfer member speed is sufficiently contained.

However, in the configuration discussed in Japanese Patent Application Laid-Open No. 2001-183888, when the photosensitive drum rotating at the same circumferential speed as that during image formation with respect to the belt member is separated from or abuts on the belt member, time required to absorb the shock is extended. Consequently, time until an imaging start on the photosensitive drum abutting on the belt member is extended, or an image defect occurs during the imaging operation. Thus, there is a demand for a configuration which can reduce a shock to the belt member as much as possible by moving the image bearing members which rotate at different circumferential speeds with respect to the belt member during image formation.

SUMMARY OF THE INVENTION

According to an aspect of the present invention, an image forming apparatus includes a first rotatable image bearing member configured to bear a toner image, a second rotatable image bearing member configured to bear a toner image, a rotatable belt member which can abut on the first and second image bearing members, a drive mechanism configured to attach or separate the second image bearing member to or from the belt member, a rotation drive mechanism configured to rotate and drive the second image bearing member, and a controller capable of controlling a rotational speed of the second image beating member so that the second image bearing member rotates with a predetermined circumferential speed difference with respect to the belt member at least when image formation is performed by using the second image bearing member. When the second image bearing member abuts on or separates from the belt member, the controller can control the rotational speed of the second image bearing member so that a circumferential speed difference between the rotational speed of the second image bearing member and a rotational speed of the belt member is smaller than the predetermined circumferential speed difference.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a table illustrating a combination of abutment/separation shocks of the photosensitive drum and the intermediate transfer belt.

DETAILED DESCRIPTION OF THE EMBODIMENTS

Various exemplary embodiments, features, and aspects of the invention will be described in detail below with reference to the drawings.

Figure 2:
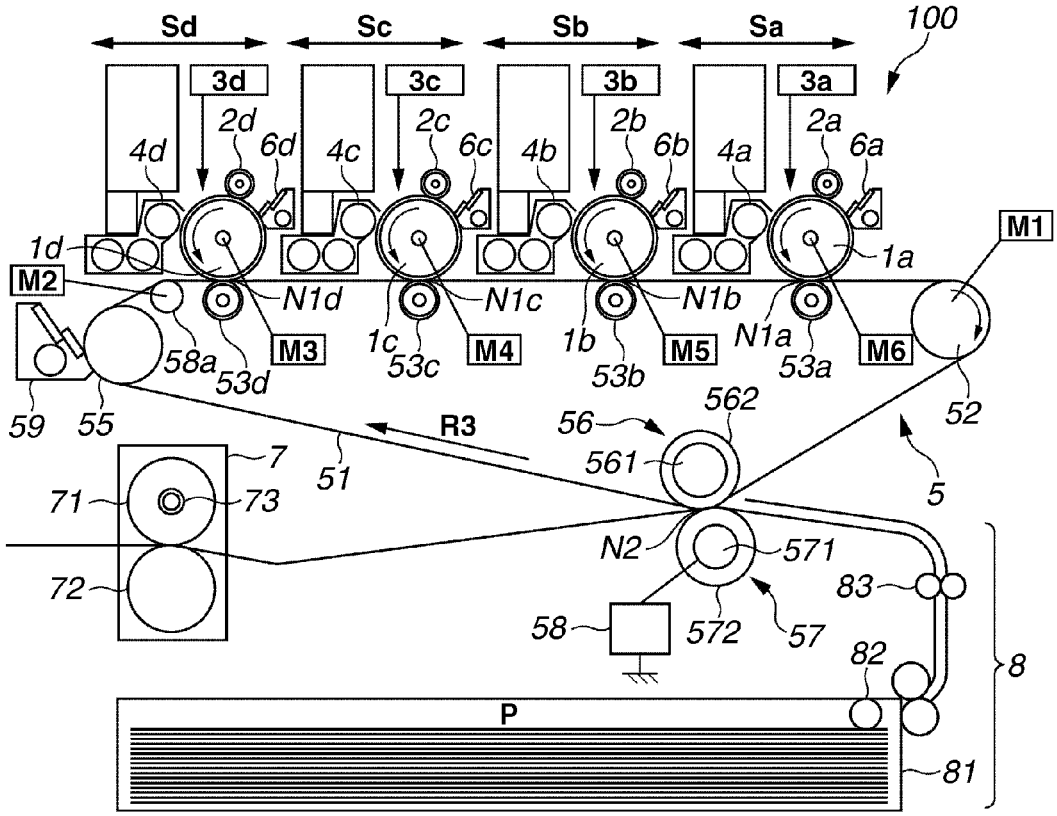
FIG. 2 is a sectional diagram illustrating a configuration of the image forming apparatus according to the exemplary embodiment of the present invention.

First, an overall configuration and an operation of an image forming apparatus according to a first exemplary embodiment of the present invention will be described. FIG. 2 illustrates a sectional configuration of an image forming apparatus 100 of the present exemplary embodiment. The image forming apparatus 100 of the exemplary embodiment is a full-color electrophotographic image forming apparatus which includes four photosensitive drums and uses an intermediate transfer method.

The image forming apparatus 100 includes first to fourth image forming units (process units) Sa to Sd as a plurality of image forming units. The image forming units Sa to Sd are respectively provided to form black, cyan, magenta, and yellow images.

In the present exemplary embodiment, the image forming units Sa to Sd are substantially similar in configuration except that different toner colors are used. Thus, the image forming units will be generically described without suffixes "a" to "d" added to the reference numerals to indicate individual colors unless otherwise needed.

The image forming unit S includes a rotatable photosensitive drum 1 as an image bearing member. Along the circumference of the photosensitive drum 1, a charge roller 2, a laser scanner 3, a development unit 4, and a drum cleaner 6 are disposed in this order in a rotational direction of the photosensitive drum 1. Further, an intermediate transfer belt 51, i.e., a rotatable belt member which can abut on the photosensitive drums 1*a* to 1*d* of the image forming units Sa to Sd is disposed as an intermediate transfer member in the present exemplary embodiment. In the present exemplary embodiment, a photosensitive drum la corresponds to a first image bearing member, a photosensitive drum 1*b* corresponds to a second image bearing member, a photosensitive drum 1*c* corresponds to a third image bearing member, and a photosensitive drum 1*d* corresponds to a fourth image bearing member.

The intermediate transfer belt 51 is suspended on a tension roller 52, a drive roller 55, a secondary transfer inner roller 56, and an upstream regulation roller 58*a* which are a plurality of support members. The intermediate transfer belt 51 receives a driving force via the drive roller 55 and rotates in a direction shown by an arrow R3. The drive roller 55 receives the driving force from a motor M1 which is a driving source for rotating the roller 55. Primary transfer rollers 53*a* to 53*d* as primary transfer members are disposed at positions facing the photosensitive drums 1*a* to 1*d* on an inner peripheral surface side of the intermediate transfer belt 51. The primary transfer rollers 53*a* to 53*d* press the intermediate transfer belt 51 to the photosensitive drums 1*a* to 1*d* to form primary transfer portions (primary transfer nip) N1*a* to N1*d* where the photosensitive drums 1*a* to 1*d* come into contact with the intermediate transfer belt 51. A second transfer outer roller 57 is disposed as a secondary transfer member at a position facing the secondary transfer inner roller 56 on an outer peripheral surface side of the intermediate transfer belt 51. The secondary transfer outer roller 57 comes into contact with the outer peripheral surface of the intermediate transfer belt 51 to form a secondary transfer portion (secondary transfer nip) N2.

Images formed on the photosensitive drums 1*a* to 1*d* by the image forming units Sa to Sd are sequentially transferred to and overlapped on the intermediate transfer belt 51 which adjacently passes the photosensitive drums 1*a* to 1*d*. Then, the images transferred to the intermediate transfer belt 51 are further transferred to the recording material P such as paper at the secondary transfer portion N2.

Figure 3:
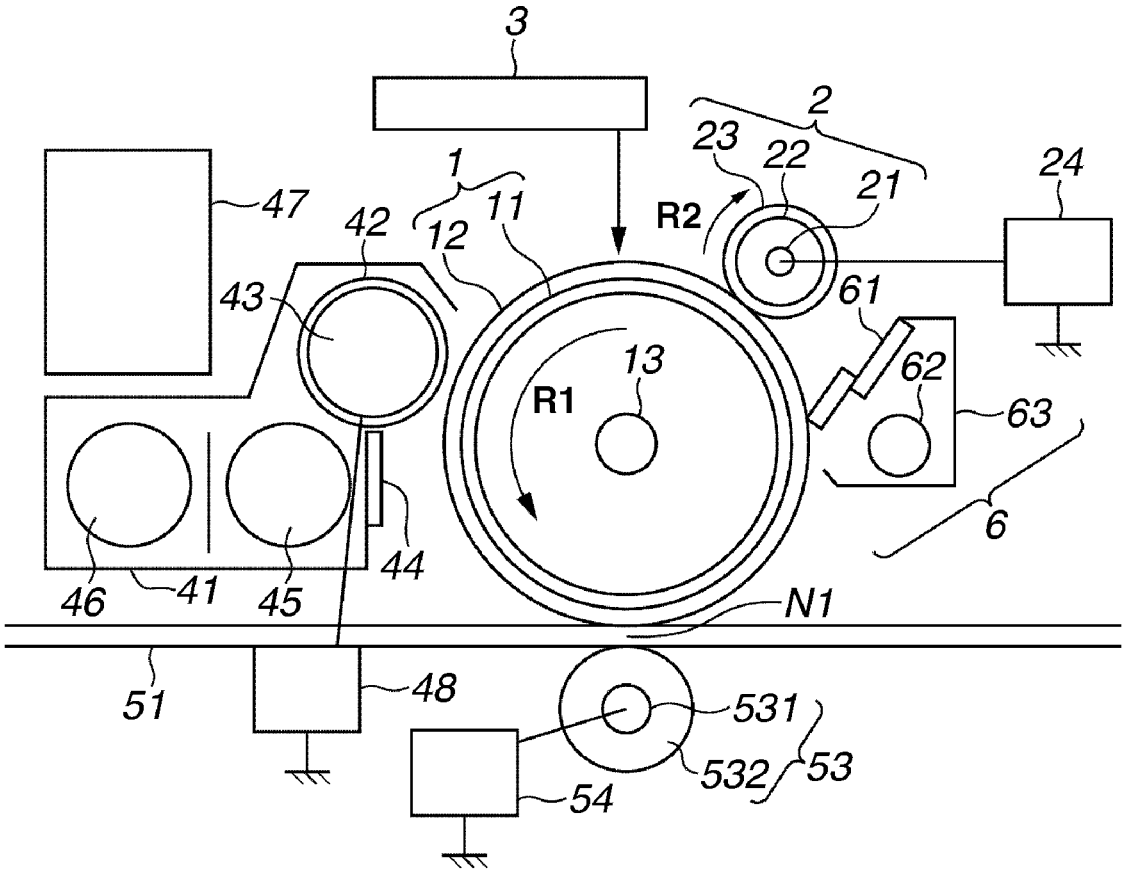
FIG. 3 is a detailed sectional diagram illustrating an image forming unit of the image forming apparatus of FIG. 2.

FIG. 3 illustrates details of the image forming unit S. Referring to FIG. 3, the photosensitive drum 1 is rotatably supported by a main body of the image forming apparatus. The photosensitive drum 1 is a cylindrical electrophotographic photosensitive member which basically includes a conductive base 11 made of aluminum or the like, and a photoconductive layer 12 formed on its outer periphery. The photosensitive drum 1 includes a spindle 13 on its center. The photosensitive drum 1 is rotated in a direction shown by an arrow R1 around the spindle 13 by the motor which is a driving source. In the present exemplary embodiment, the photosensitive drum 1 has a negative charge polarity.

The charge roller 2 is disposed as a primary charge unit above the photosensitive drum 1. The charge roller 2 comes into contact with the surface of the photosensitive drum 1 to uniformly charge the surface thereof to a predetermined polarity and a potential. The charge roller 2 includes a conductive core metal 21 disposed on the center, a low-resistance conductive layer 22 formed on its outer periphery, and a mid-resistance conductive layer 23, which are formed into a roller shape as a whole. In the charge roller 2, both ends of the core metal 21 are rotatably supported by bearing members (not shown), and disposed in parallel with the photosensitive drum 1. The bearing members of both ends are pressed to the photosensitive drum 1 by a pressing unit (not shown). Thus, the charge roller 2 is pressed into contact with the surface of the photosensitive drum 1 by a predetermined pressing force. The charge roller 2 is rotated in a direction shown by an arrow R2 owing to rotation of the photosensitive drum 1 in the direction shown by the arrow R1. The charge roller 2 receives a charge bias voltage from a charge bias power source 24. Thus, the surface of the photosensitive drum 1 is uniformly charged by contacting with the charge roller 2.

A laser scanner 3 is disposed on a downstream side of the charge roller 2 in a rotational direction of the photosensitive drum 1. The laser scanner 3 performs scanning based on image information by turning a laser beam ON and OFF to expose a portion on the photosensitive drum 1. Thus, an electrostatic image (latent image) is formed on the photosensitive drum 1 according to the image information.

The development unit 4 is disposed on the downstream side of the laser scanner 3 in the rotational direction of the photosensitive drum 1. The development unit 4 includes a developer container 41 that contains a two-component developer containing nonmagnetic toner particles (toner) and magnetic carrier particles (carrier) as developers. A development sleeve 42 is rotatably disposed as a developer bearing member in an opening of the developer container 41 facing the photosensitive drum 1. The development sleeve 42 includes a magnetic roller 43 as a magnetic field generation unit that is fixed with respect to rotation of the development sleeve 42 to prevent rotation. The two-component developer is borne on the development sleeve 42 by a magnetic field generated by the magnet roller 43. In a position below the development sleeve 42, a regulation blade 44 is installed as a developer regulation member for regulating the two-component developer borne on the development sleeve 42 to thin a developer layer. The developer container 41 is divided into a development chamber 45 and a stirring chamber 46, and a replenishing chamber 47 containing a replenishment toner is disposed above these chambers.

The thin layer of the two-component developer on the development sleeve 42 is conveyed to a development area facing the photosensitive drum 1 by rotation of the development sleeve 42. Then, the two-component developer on the development sleeve 42 is napped in the development area to form a magnetic brush of the two-component developer by a magnetic force of a development main pole of the magnet roller 43 which is positioned in the development area. The magnetic brush rubs the surface of the photosensitive drum 1, and a development bias power source 48 applies a development bias voltage to the development sleeve 42. Thus, the toner stuck to carriers constituting the nap of the magnetic brush adheres to an exposure portion of the electrostatic image on the photosensitive drum 1 and forms a toner image. In the present exemplary embodiment, the toner image is formed on the photosensitive drum 1 by utilizing reversal development in which a toner charged to a same charge polarity as the photosensitive drum 1 sticks to a portion of the photosensitive drum 1 where charges are decayed by exposure.

A primary transfer roller 53 is disposed below the photosensitive drum 1 on the downstream side of the development unit 4 in the rotational direction of the photosensitive drum 1. The primary transfer roller 53 includes a core metal 531, and a conductive layer 532 with a cylindrical shape formed on its outer peripheral surface. Both ends of the primary transfer roller 53 are pressed to the photosensitive drum 1 by a pressing member (not shown) such as a spring. Thus, the conductive layer 532 of the primary transfer roller 53 is pressed onto the surface of the photosensitive drum 1 by a predetermined pressing force via the intermediate transfer belt 51. A primary transfer bias power source 54 is connected to the core metal 531. A primary transfer portion N1 is formed between the photosensitive drum 1 and the primary transfer roller 53. The intermediate transfer belt 51 is nipped at the primary transfer portion N1. The primary transfer roller 53 comes into contact with an inner peripheral surface of the intermediate transfer belt 51 and rotates along with movement of the intermediate transfer belt 51. During image formation, the primary transfer bias power source 54 applies a primary transfer bias voltage with a polarity (second polarity: positive polarity in the present exemplary embodiment) reverse to a normal charge polarity (first polarity: negative polarity in the present exemplary embodiment) of the toner to the primary transfer roller 53. Then, an electric field is formed between the primary transfer roller 53 and the photosensitive drum 1 to move the toner of the first polarity from the photosensitive drum 1 to the intermediate transfer belt 51. Thus, the toner image on the photosensitive drum 1 is transferred (primary transfer) to the surface of the intermediate transfer belt 51.

Particles, such as the toner (residual primary transfer toner), remaining on the surface of the photosensitive drum 1 after the primary transfer process is cleaned by the drum cleaner 6. The drum cleaner 6 includes a cleaning blade 61, a convey screw 62, and a drum cleaner housing 63 as cleaning members. The cleaning blade 62 is brought into contact with the photosensitive drum 1 at a predetermined angle and pressure by a pressing unit (not shown). Thus, the toner remaining on the surface of the photosensitive drum 1 is scratched off therefrom by the cleaning blade 62, and collected in the drum cleaner housing 63. The collected toner is conveyed by the convey screw 62 and discharged to a waste toner containing unit (not shown).

In FIG. 2, below the photosensitive drums 1*a* to 1*d*, an intermediate transfer unit 5 is provided, which includes the intermediate transfer belt 51, the primary transfer rollers 53*a* to 53*d*, the secondary transfer inner roller 56, the second transfer outer roller 57, and an intermediate transfer belt cleaner 59. The secondary transfer inner roller 56 is electrically grounded. The secondary transfer bias power source 58 is connected to the secondary transfer outer roller 57. The secondary transfer inner roller 56 comes into contact with the inner peripheral surface of the intermediate transfer belt 51 and rotates along with the movement of the intermediate transfer belt 51.

For example, during a full-color image formation, toner images of respective colors are formed on the photosensitive drums 1*a* to 1*d* of the first to fourth image forming units Sa to Sd. The toner images of the respective colors receive primary transfer biases from the primary transfer rollers 53*a* to 53*d* facing the photosensitive drums 1*a* to 1*d* across the intermediate transfer belt 51 and are sequentially transferred (primary-transfer) to the intermediate transfer belt 51. The toner images are conveyed to the secondary transfer portion N2 along with rotation of the intermediate transfer belt 51.

By this time, a recoding material feed unit 8 conveys the recording material P to the secondary transfer portion N2. In other words, in the recording material feed unit 8, the recording material P is picked up one by one by a pickup roller 82 from a cassette 81 serving as a recording material storage unit and conveyed to the secondary transfer portion N2 by a convey roller 83.

In the present exemplary embodiment, during image formation, a secondary transfer bias voltage is applied to the secondary transfer outer roller 57 with a polarity (second polarity: positive polarity in the exemplary embodiment) reverse to the normal charge polarity (first polarity: negative polarity in the exemplary embodiment) of the toner from the secondary transfer bias power source 58. Then, an electric field is formed between the secondary transfer inner roller 56 and the secondary transfer outer roller 57 in a direction to move the toner of the first polarity from the intermediate transfer belt 51 to the recording material P. Thus, the toner images on the intermediate transfer belt 51 are transferred (secondary transfer) to the recording material P. The recording material P having the toner images transferred at the secondary transfer portion N2 is conveyed to a fixing unit 7.

Particles, such as toner (secondary transfer residual toner), remaining on the outer peripheral surface of the intermediate transfer belt 51 after the secondary transfer process is removed and collected by the intermediate transfer belt cleaner 59 as a belt cleaning member. The intermediate transfer belt cleaner 59 has a configuration similar to that of the drum cleaner 6.

The fixing unit 7 includes a fixing roller 71 as a fixing member which is disposed to be freely rotatable, and a pressure roller 72 as a pressure member, which is pressed to the fixing roller 71 while rotating. A heater 73 as a heating member such as a halogen lamp is disposed in the fixing roller 71. Surface temperature of the fixing roller 71 is adjusted by controlling a voltage applied to the heater 73. The recording material P which is conveyed to the fixing unit 7 is pressed and heated from both sides thereof at constant pressure and temperature while passing between the fixing roller 71 and the pressure roller 72 which are rotating at a certain speed. An unfixed toner image on the surface of the recording material P is melted to be fixed thereon. Thus, a full-color image is formed on the recording material P.

The intermediate transfer belt 51 can be made of a dielectric resin such as polycarbonate (PC), polyethylene terephthalate (PET) or polyvinylidene fluoride (PVDF). In the present exemplary embodiment, the intermediate transfer belt 51 which is made of a polyimide (PI) resin having surface resistivity $10^{12}$ Ω/□ (using JIS-K6911 compatible probe, applied voltage 100 V, application time 60 seconds, 23° C./50% RH) and a thickness of 100 μm is used. However, conditions of the intermediate transfer belt 51 are not limited to the above, and other materials with different volume resistivity, and thickness may be used.

The primary transfer roller 53 includes a core metal 531 of an outer diameter 8 mm, and a conductive urethane sponge layer 532 of a thickness 4 mm. An electric resistance value of the primary transfer roller 53 is about $10^5$Ω (23° C./50% RH). The electric resistance value of the primary transfer roller 53 is calculated from an electric current value measured by rotating the primary transfer roller 53 abutting on a metal roller grounded under a load of 500 g at a circumferential speed of 50 mm/second and applying a voltage of 100 V to the core metal 531.

The secondary transfer inner roller 56 includes a core metal 561 of an outer diameter 18 mm, and a conductive solid silicon rubber layer 562 of a thickness 2 mm. An electric resistance value of the secondary transfer inner roller 56 is about $10^4$Ω measured by a method similar to that of the primary transfer roller 53. The secondary transfer outer roller 57 includes a core metal 571 of an outer diameter 20 mm, and a conductive ethylene-propylene-diene monomer (EPDM) rubber sponge layer 572 of a thickness 4 mm. An electric resistance value of the secondary transfer outer roller 57 is about $10^8$Ω by applying a voltage of 2000 V in a measuring method similar to that of the primary transfer roller 53.

The image forming apparatus of the present exemplary embodiment has a full-color mode and a black single color mode, and the intermediate transfer belt abuts on or separated from the photosensitive drum according to the mode. The full-color mode is for forming a color image on a recording material by using the image forming units Sa to Sd. The black single color mode is for forming an image on a recoding material by using the image forming unit Sa for forming a black toner image. FIG. 2 illustrates a position of the intermediate transfer belt 51 when the image forming apparatus of the present exemplary embodiment performs an imaging operation in the full-color mode. The intermediate transfer belt 51 comes into contact with the photosensitive drums 1*a* to 1*d* to form transfer nips N1*a* to N1*d*, and images of four colors are sequentially transferred thereto. To regulate the position of the intermediate transfer belt 51, an upstream regulation roller 58*a* as a moving member is set in a position as illustrated in FIG. 2, and the surface of the intermediate roller 51 which is suspended on the upstream regulation roller 58*a* and the tension roller 52 is parallel to the photosensitive drums 1*a* to 1*d*. The moving member is moved between the following two positions by the motor M2. A moving unit of the present exemplary embodiment includes the moving member and the motor M2 for moving the moving member.

Figure 4:
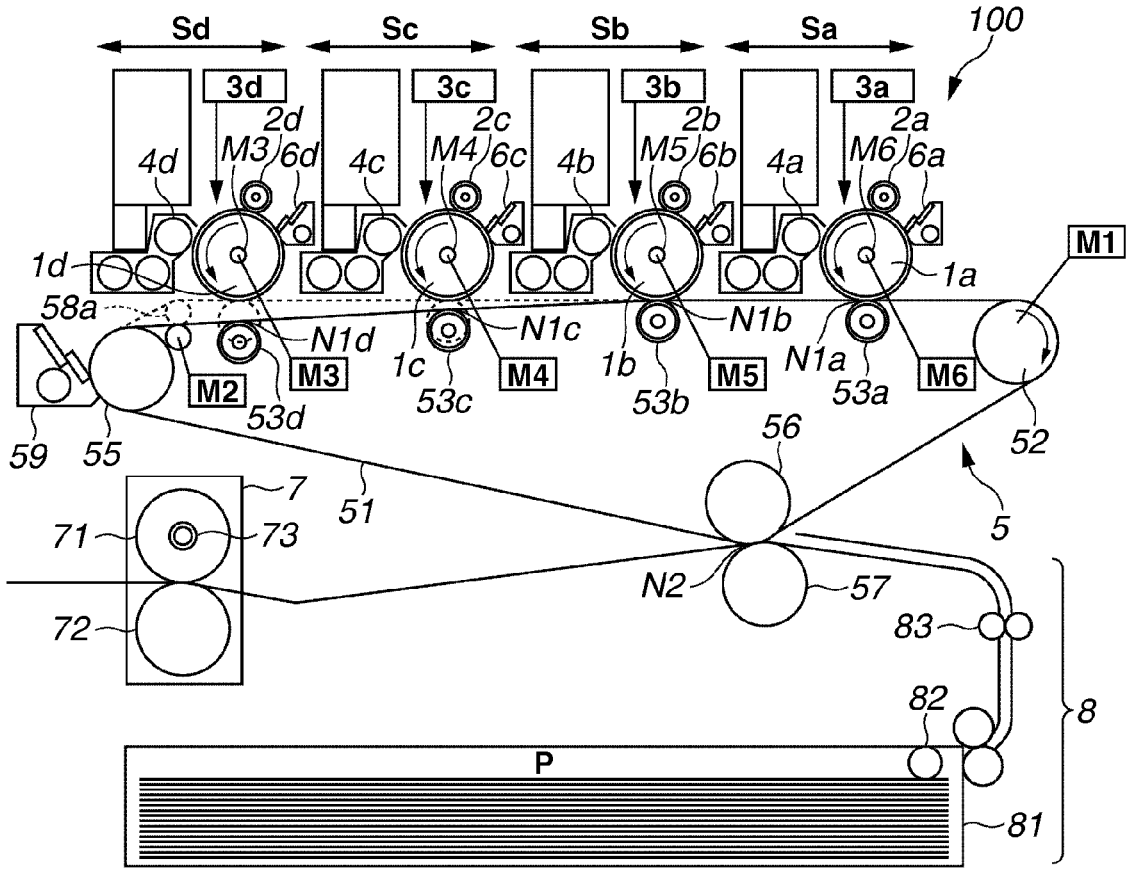
FIG. 4 is a sectional diagram illustrating the image forming apparatus of FIG. 2 in a black single color mode.

FIG. 4 illustrates the position of the intermediate transfer belt 51 when the image forming apparatus of the present exemplary embodiment is in the black single color mode. The intermediate transfer belt 51 comes into contact with only the photosensitive drum 1*a* to form the transfer nip N1*a*, and only a black single color image is transferred to the intermediate transfer belt. To regulate the position of the intermediate transfer belt 51 in this case, the upstream regulation roller 58*a* (shown in a broken line in the drawing) is retreated to a position shown in a solid line in the drawing. In the present exemplary embodiment, the upstream regulation roller 58*a* is in contact with the intermediate transfer belt 51 when it is retreated. Even when the upstream regulation roller 58*a* does not regulate the intermediate transfer belt 51, the position thereof is regulated by the tension roller 52, therefore the upstream regulation roller 58*a* does not always have to regulate the intermediate transfer belt 51.

Setting of a circumferential speed difference between the photosensitive drum and the intermediate transfer belt according to the present exemplary embodiment will be described below in detail.

In the image forming apparatus of FIG. 2, the photosensitive drums 1*a* to 1*d* and the intermediate transfer belt 51 are independently driven by driving sources (motors M3 to M6). The intermediate transfer belt 51 receives the driving force from the motor M1 via the drive roller 55. In the present exemplary embodiment, driving forces are independently transmitted from the respective motors to the photosensitive drums. However, the image forming apparatus may employ a configuration where a motor for driving a black photosensitive drum and motors for driving other photosensitive drums are provided. In the image forming apparatus of the present exemplary embodiment, circumferential speeds (rotational speeds) corresponding to surface moving speeds of the photosensitive drums 1*a* to 1*d* and the intermediate transfer belt 51 are set to different values during image formation. Circumferential speeds of the photosensitive drums 1*a* to 1*d* are 100.5 mm/second, and a circumferential speed of the intermediate transfer belt 51 is 100 mm/second. As described above, by rotating the photosensitive drum and the intermediate transfer belt at the different circumferential speeds, a toner image formed on the photosensitive drum is rubbed on the intermediate transfer belt and receives a shearing force, so that an adhesive force of the toner image to the photosensitive drum is weakened. Thus, a transfer efficiency can be improved.

The circumferential speeds of the photosensitive drum and the belt member abutting thereon are set based on the following point of view. In the present exemplary embodiment, the drive roller 55 for driving the intermediate transfer belt 51 and the tension roller 52 for adding a tension thereto are respectively disposed on the upstream side and the downstream side of the rotational direction of the intermediate transfer belt 51 with respect to the photosensitive drum 1. In this configuration, it is desirable to set the circumferential speed of the photosensitive drum 1 faster than that of the intermediate transfer belt 51. It is because the intermediate transfer belt 51 has to be stably suspended between the tension roller 52 and the drive roller 55 to constitute a primary transfer surface. Thus, if the circumferential speed of the intermediate transfer belt 51 is set faster, the drive roller 55 applies a force to rotate the intermediate transfer belt 51 faster than the photosensitive drum 1, and the intermediate transfer belt 51 may be slackened between the photosensitive drum 1*a* and the drive roller 55. Especially, formation of the yellow transfer nip N1*d* becomes unstable. When the circumferential speed of the intermediate transfer belt 51 is set slower than that of the photosensitive drum 1, the intermediate transfer belt 51 on the downstream side of the drive roller 55 can be stably suspended by receiving a force in the rotational direction from the photosensitive drum 1. A configuration in which the intermediate transfer belt 51 is pulled by the photosensitive drum 1 will be referred to as "drum fast speed system" hereinafter.

On the other hand, another configuration will be considered, in which the drive roller for driving the intermediate transfer belt and the tension roller for adding the tension thereto are respectively disposed on the downstream side and the upstream side of the rotational direction of the intermediate transfer belt with respect to the photosensitive drum 1. In such a configuration, in contrast to the previous case, it is desirable to set the circumferential speed of the photosensitive drum slower than that of the intermediate transfer belt. When the circumferential speed of the intermediate transfer belt is set slower, the photosensitive drum applies a rotational force to the intermediate transfer belt faster than the drive roller. Therefore, the intermediate transfer belt between the photosensitive drum 1*d* on the downmost stream side and the drive roller is slackened, and formation of the black transfer nip N1*a* becomes unstable. When the circumferential speed of the intermediate transfer belt is set faster than that of the photosensitive drum 1, the intermediate transfer belt on the upstream side of the drive roller can be stably suspended by receiving a pulling force in a direction reverse to the rotational direction from the photosensitive drum. A configuration in which the intermediate transfer belt receiving a rotation regulating force from the photosensitive drum is pulled by the drive roller will be referred to as a "belt fast rotation system" hereinafter.

Shocks caused by a switching operation of the full-color mode and the black single color mode for attaching/separating the intermediate transfer belt to/from the photosensitive drum in the "drum fast rotation system" and the "belt fast rotation system" will be described.

The "drum fast rotation system" according to the present exemplary embodiment will be described. In the present exemplary embodiment, speeds of the photosensitive drums 1*a* to 1*d* are 100.5 mm/second, and a circumferential speed of the intermediate transfer belt 51 is 100 mm/second. All the photosensitive drums and the intermediate transfer belt are driven to independently control the motor speeds. In the full-color mode, all the photosensitive drums 1*a* to 1*d* abut on the intermediate transfer belt 51 to perform imaging operations. In the black single color mode, by retreating the upstream regulation roller 58*a* as shown in FIG. 4, the intermediate transfer belt 51 is separated from areas corresponding to the photosensitive drums 1*b* to 1*d*. The intermediate transfer belt 51 receives rotational-direction forces from the photosensitive drums 1*a* to 1*d* in the full-color mode, while the intermediate transfer belt 51 receives a rotational-direction force only from the photosensitive drum 1*a* in the black single color mode. Thus, during switching from the full-color mode to the black single color mode, in other words, during a separation operation of the intermediate transfer belt 51, a driving force of the intermediate transfer belt 51 is instantaneously reduced, and uneven rotation of the intermediate transfer belt 51 occurs. The uneven rotation causes uneven rotation of the black photosensitive drum 1*a*. In a case where an imaging operation such as charging, exposure or development is performed on the black photosensitive drum 1*a*, an image on the black photosensitive drum 1*a* is transferred to the intermediate transfer belt 51, or a toner image on the intermediate transfer belt 51 is secondarily transferred to paper, the uneven rotation may adversely affect an image.

FIG. 6 is a table illustrating combinations of the "drum fast rotation system", the "belt fast rotation system" and "separation" and "abutment" of the intermediate transfer belt. In the "drum fast rotation system", an operation from the full-color mode to the black single color mode, i.e., "separation" of the intermediate transfer member from the photosensitive drum, is set as a mode 1. Similarly, an operation of "abutment" in the "drum fast rotation system" is set as a mode 2. Similarly, a "separation" operation and an "abutment" operation in the "belt fast rotation system" are respectively set as a mode 3 and a mode 4. In any of these combinations, shocks caused by abutment and separation of the intermediate transfer belt during switching may adversely affect an image. According to the present exemplary embodiment, however, performing optimal driving control of the photosensitive drum described below for each mode can prevent influence of the above described shocks on the image.

Figure 7:
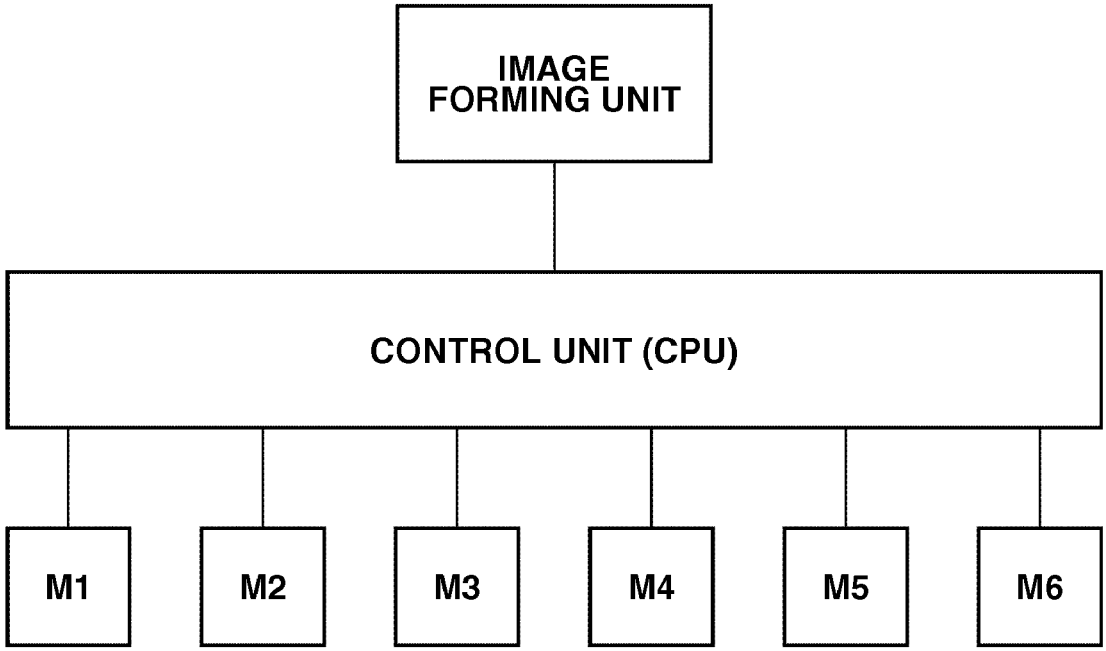
FIG. 7 is a block diagram of the exemplary embodiment of the present invention.

Control of the circumferential speed of the photosensitive drum while attaching and separating the intermediate transfer belt to and from the photosensitive drum will be described. In the present exemplary embodiment, as shown in FIG. 7, the control unit (CPU) controls a speed of each motor. A mode switching control unit of the CPU performs switching between the full-color mode and the black single color mode. The CPU includes a speed change unit for changing a speed of the image bearing member, and controls a speed of the photosensitive drum by the speed control unit during attachment and separation. The CPU further includes a movement control unit for moving the moving member.

FIGS. 1A to 1D illustrate circumferential speeds of the photosensitive drums 1*a* to 1*d* and the intermediate transfer belt 51. A horizontal axis indicates time and a vertical axis indicates the circumferential speeds of the photosensitive drums 1*a* to 1*d* and the intermediate transfer belt. FIGS. 1A to 1D correspond to the modes 1 to 4 of FIG. 6. The image forming apparatus of the present exemplary embodiment is the "drum fast rotation system" in which a separation operation of the intermediate transfer belt 51 is set as the mode 1, and an attachment operation is set as the mode 2. First, control of the mode 1 will be described below in detail.

In the image forming apparatus of the present exemplary embodiment, the photosensitive drums 1*a* to 1*d* rotate at the circumferential speed of 100.5 mm/second, and the intermediate transfer belt 51 rotates at the circumferential speed of 100 mm/second in the full-color mode. Two-headed arrows in FIG. 1A indicate time period of forming toner images on the photosensitive drums 1*a* to 1*d*. The toner images are formed in order of yellow (Y), magenta (M), cyan (C), and black (K). These toner images are primary-transferred sequentially to the intermediate transfer belt 1 to be overlapped each other. When the full-color mode is finished and switched to the black single color mode, as soon as the transfer of the toner image on each photosensitive drum to the intermediate transfer belt 51 is finished, the speeds of the photosensitive drums 1*b* to 1*d* are sequentially reduced to 100 mm/second equal to that of the intermediate transfer belt 51. Then, the intermediate transfer belt 51 is separated from the photosensitive drums 1*b* to 1*d*, and the photosensitive drums 1*b* to 1*d* stop rotation. During a series of operations, namely when reducing the speeds of the photosensitive drums 1*b* to 1*d*, separating the intermediate transfer belt 51, and stopping the photosensitive drums 1*b* to 1*d*, the toner images are continuously formed on the photosensitive drum 1*a* to form the black toner image. Thus, images are continuously formed without any downtime due to mode switching.

According to the present exemplary embodiment, as described above, when the mode is switched to the black single color mode, the circumferential speed difference between the photosensitive drum and the intermediate transfer belt is minimized or the circumferential speeds of the photosensitive drum and the intermediate transfer belt are substantially made equal. Then, the intermediate transfer belt is separated. With this configuration, an influence of the shocks on the intermediate transfer belt and the photosensitive drum 1*d* for forming the black toner image due to separation can be minimized. Further, according to the present exemplary embodiment, timing for changing the speed is different based on color. This configuration can reduce loads on the intermediate transfer belt 51. Thus, even when imaging (charging, exposure, and development), primary transfer, and secondary transfer from the intermediate transfer belt to the recording material of the black toner image are continuously performed, shocks due to separation of the intermediate transfer belt can be reduced.

By reducing the speeds starting from the yellow photosensitive drum 1*d* which is the farthest from the black photosensitive drum 1*a* having a fast circumferential speed, a force for pulling the surface of the intermediate transfer belt 51 to the upstream side is constantly applied by the photosensitive drum. Thus, the primary transfer surface can be stabilized.

In the above description, the circumferential speed of the photosensitive drum is 100.5 mm/second and the circumferential speed of the intermediate transfer belt is 100 mm/second. However, a relationship of the circumferential speeds is not limited to the above described example. Further, in the above description, when the speed of the photosensitive drum is reduced, the speed of the photosensitive drum is controlled to decrease to 100 mm/second which is equal to that of the intermediate transfer belt. However, the reduced speed may be set to any value as long as it is smaller than the original circumferential speed (100.5 mm/second) of the photosensitive drum and equal to or greater than the circumferential speed (100 mm/second) of the intermediate transfer belt. However, the closer the reduced speed is to the circumferential speed of the intermediate transfer belt, the more the shocks due to separation can be reduced.

Figure 5:
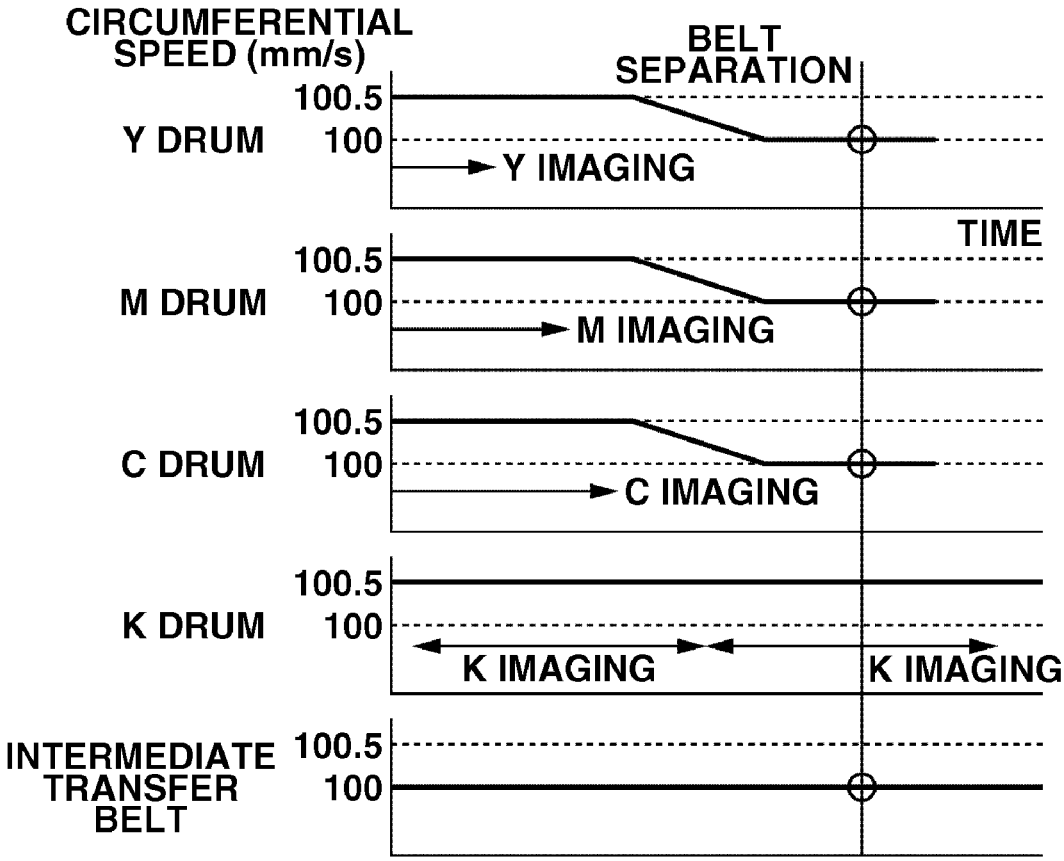
FIG. 5 illustrates circumferential speeds of the photosensitive drum and the intermediate transfer belt of the image forming apparatus according to the exemplary embodiment of the present invention.

FIG. 5 illustrates another method for deceleration control of the photosensitive drums 1*b* to 1*d* in the mode 1. In the drawing, the photosensitive drums 1*b* to 1*d* are continuously decelerated from 100.5 mm/second to 100 m/second. Such deceleration control can reduce an influence of the shocks on the intermediate transfer belt 51 during deceleration of the photosensitive drums 1*b* to 1*d*. This method can reduce rotational loads on the intermediate transfer belt even when a plurality of photosensitive drums starts reducing the speed at the same timing. A similar effect can be obtained by gradually reducing speeds, specifically, reducing the speed from 100.5 mm/second to 100.4 mm/second, 100.3 mm/second, 100.2 mm/second, and 100.1 mm/second. The control for shifting deceleration timing of the photosensitive drums and the control for gradually reducing the speed can be combined.

Figure 1A:
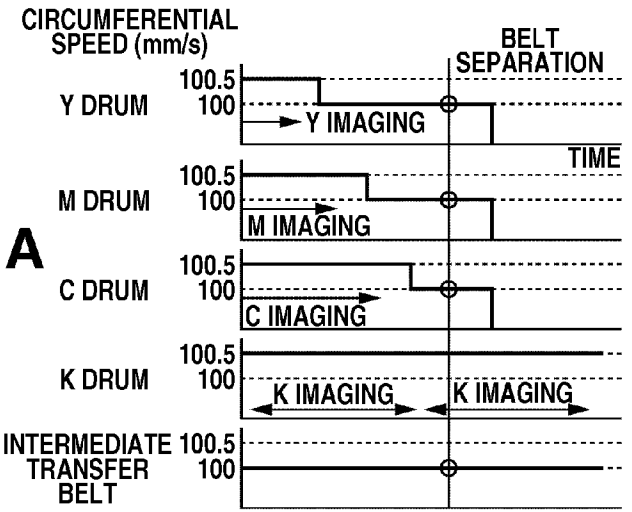
FIGS. 1A to 1D illustrate circumferential speeds of a photosensitive drum and an intermediate transfer belt of an image forming apparatus according to an exemplary embodiment of the present invention.
Figure 1B:
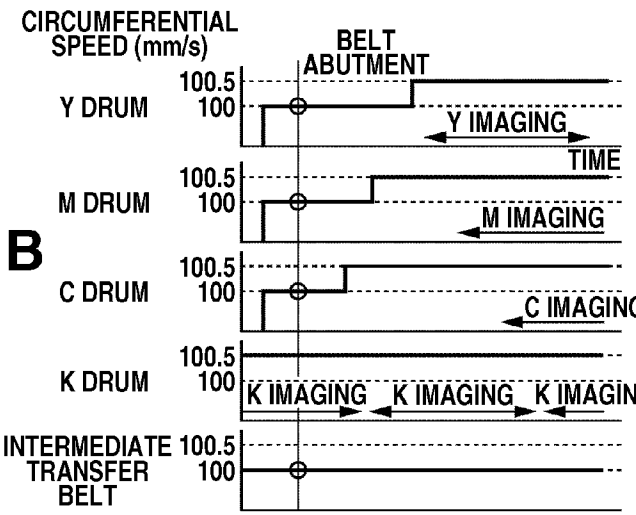

FIG. 1B illustrates control when the intermediate transfer belt 51 abuts on the photosensitive drums at the time of switching the black single color mode to the full-color mode.

During the black single color mode, the photosensitive drums 1*b* to 1*d* are not rotated. The photosensitive drum 1*a* rotates at 100.5 mm/second, the intermediate transfer belt 51 rotates at 100 mm/second, and a back toner image formed on the photosensitive drum 1*a* is primary-transferred to the intermediate transfer belt 51. Subsequently, to switch from the black single color mode to the full-color mode, the photosensitive drums 1*b* to 1*d* are controlled to rotate at a speed of 100 mm/second equal to that of the intermediate transfer belt 51. Then, the intermediate transfer belt 51 abuts on the photosensitive drums 1*b* to 1*d*. In this case, since the photosensitive drums 1*b* to 1*d* and the intermediate transfer speed 51 are set to the equal speed, the intermediate transfer belt 51 stably rotates without receiving any shocks due to attachment. The speeds of the photosensitive drums 1*b* to 1*d* are gradually increased to 100.5 mm/second which is setting at the time of forming an image. During this period, the black toner images are continuously formed on the photosensitive drum 1*a* for forming the black toner image, and forming of the image is not interrupted by switching of the mode.

As described above, in this mode, before the intermediate transfer belt 51 abuts on the photosensitive drums 1*b* to 1*d*, the speeds of the photosensitive drums 1*b* to 1*d* approach the speed of the intermediate transfer belt 51. Then, the intermediate transfer belt 51 abuts on the photosensitive drums, so that the shocks to the intermediate transfer belt and the photosensitive drum 1*a* for forming the black toner image can be minimized. As a result, even when imaging (charging, exposure and development), primary transfer, and secondary transfer from the intermediate transfer belt to the recording material of the black toner image are continuously performed, the shocks due to abutment can be reduced.

In this case, by gradually increasing the speeds from the photosensitive drum close to the black photosensitive drum la, a force for pulling the surface of the intermediate transfer belt 51 to an upstream side can constantly be applied by the photosensitive drum. Thus, the primary transfer surface can be stabilized.

Figure 1C:
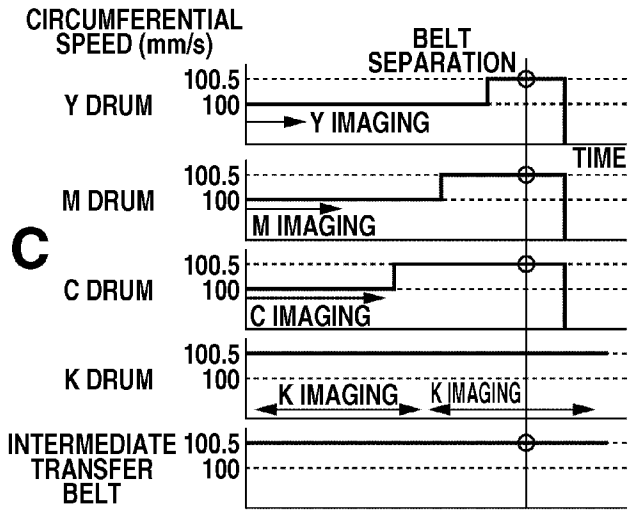
Figure 1D:
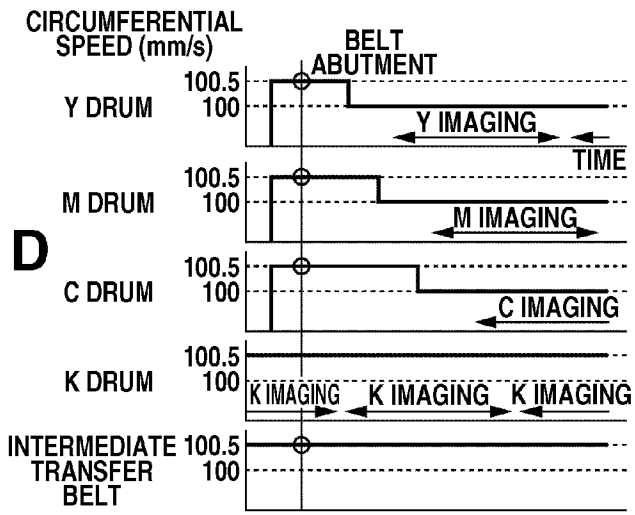

FIGS. 1C and 1D illustrate control of the photosensitive drum and the intermediate transfer belt corresponding to the modes 3 and 4. As in the case of the above described control, attachment and separation are performed after the circumferential speed of the photosensitive drum approaches that of the intermediate transfer belt as much as possible.

The method described above can reduce shocks on an imaging unit of the black photosensitive drum, primary transfer unit and secondary transfer unit due to attachment and separation of the intermediate transfer belt during switching between the full-color mode and the black single color mode.

Next, another exemplary embodiment of the present invention will be described below.

Figure 8:
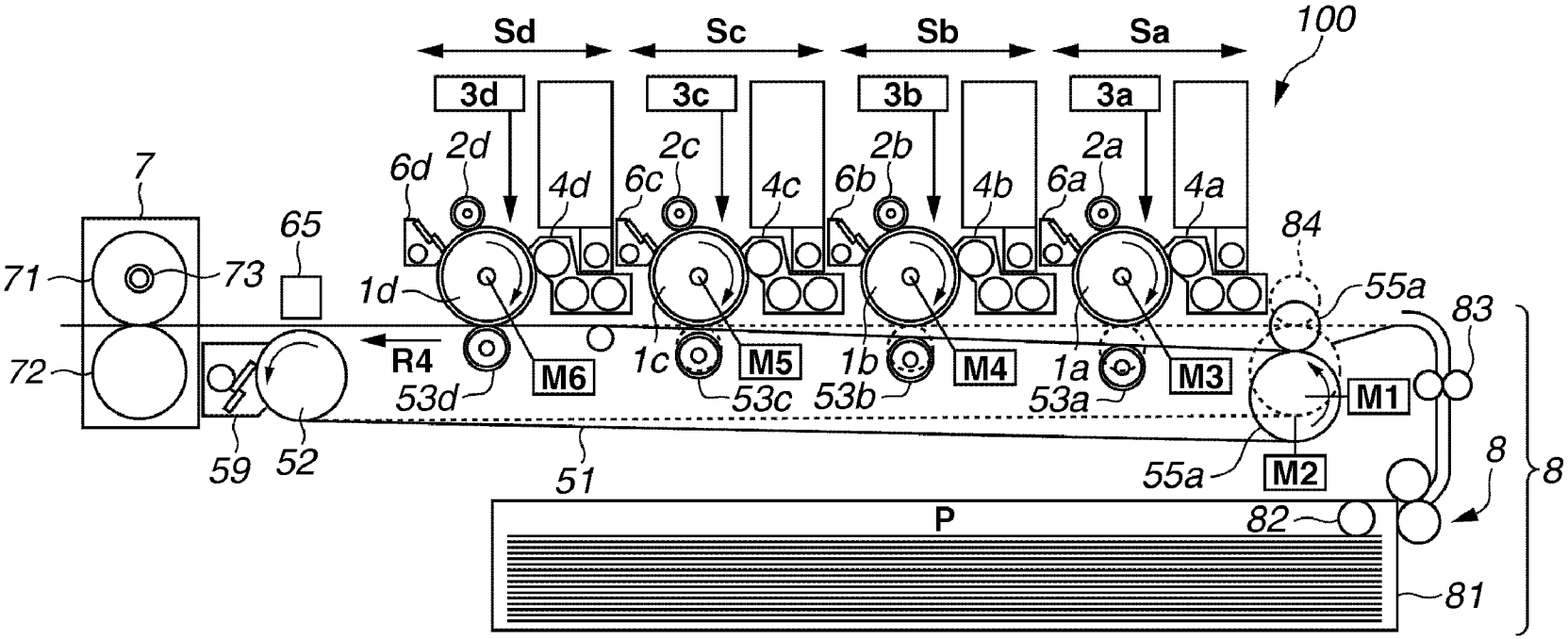
FIG. 8 is a sectional diagram illustrating a configuration of an image forming apparatus according to another exemplary embodiment of the present invention.
Figure 9:
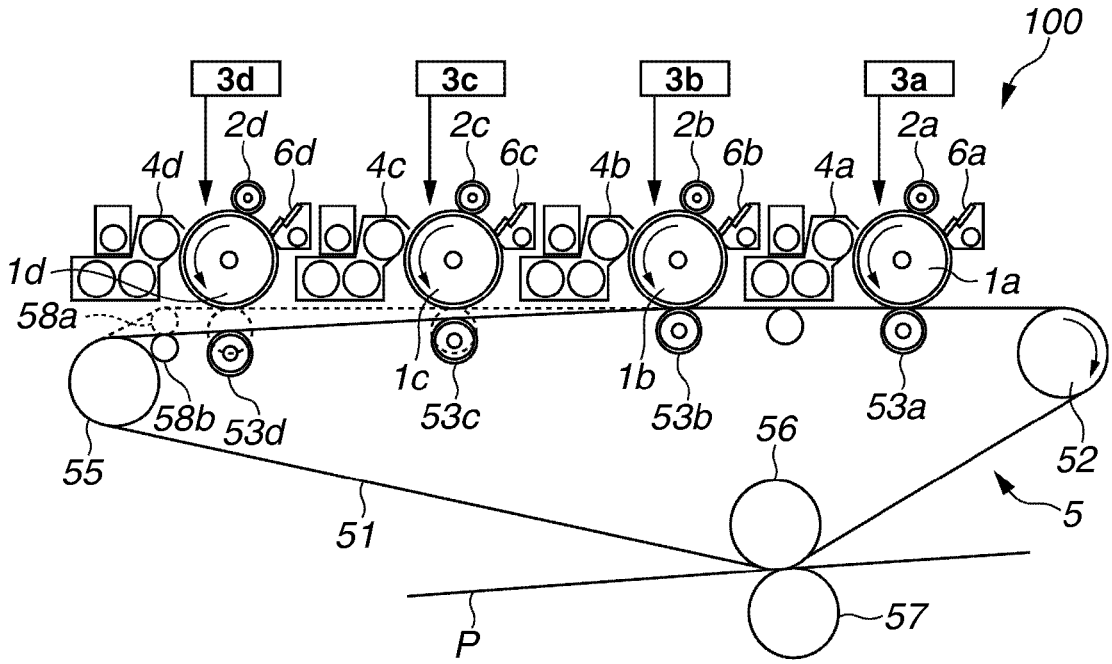
FIG.9 PRIOR ART
FIG. 9 is a sectional diagram illustrating a configuration of a conventional image forming apparatus.

FIG. 8 illustrates a sectional configuration of an image forming apparatus 200 of a second exemplary embodiment. The image forming apparatus 200 of the present exemplary embodiment is a full-color electrophotographic image forming apparatus which uses a direct transfer method.

In the image forming apparatus 200 of the present exemplary embodiment shown in FIG. 8, functions and components substantially similar to those of the image forming apparatus 100 shown in FIG. 2 are denoted by same reference numerals, and detailed description thereof will be omitted. In the image forming apparatus 200 of the present exemplary embodiment, configurations of image forming units Sa to Sd are substantially similar to one another except that different toner colors are used. Thus, the image forming units will be generically described without suffixes "a" to "d" added to the reference numerals to indicate individual colors unless otherwise needed.

The image forming apparatus 200 of the present exemplary embodiment includes a rotatable belt member, i.e., a transfer belt 51, as a recording material bearing member adjacent to photosensitive drums 1*a* to 1*d* of the image forming units Sa to Sd. The transfer belt 51 is suspended on a drive roller 55*a* and a tension roller 52 which constitute a plurality of support members. The transfer belt 51 receives a driving force from the drive roller 55*a* and rotates in a direction shown by an arrow R4.

Transfer rollers 53*a* to 53*d* as transfer members are disposed at positions facing the photosensitive drums 1*a* to 1*d* on an inner peripheral surface side of the transfer belt 51. The transfer rollers 53*a* to 53*d* press the transfer belt 51 to the photosensitive drums 1*a* to 1*d* to form transfer portions (transfer nips) where the transfer belt 51 comes into contact with the photosensitive drums 1*a* to 1*d*.

In the image forming apparatus 200 of the present exemplary embodiment, images formed on the photosensitive drums 1*a* to 1*d* by the image forming units Sa to Sd are sequentially transferred to and overlapped on a recording material P such as paper on the transfer belt 51 which adjacently passes the photosensitive drums 1*a* to 1*d*.

During image formation, a recoding material feed unit 8 conveys the recording material P to the transfer belt 51. In other words, in the recording material feed unit 8, the recording material P is picked up one by one by a pickup roller 82 from a cassette 81 as a recording material storage unit and conveyed to the transfer belt 51 by a convey roller 83. The recording material P is electrostatically attracted onto the transfer belt 51 by an attraction roller 84, and conveyed to transfer portions of the image forming units Sa to Sd.

For example, during full-color image formation, toner images of respective colors are formed on the photosensitive drums 1*a* to 1*d* of the first to fourth image forming units Sa to Sd. The toner images of the respective colors receive transfer biases from the transfer rollers 53*a* to 53*d* facing the photosensitive drums 1*a* to 1*d* across the recording material P and the transfer belt 51 and are sequentially transferred to the recording material P on the transfer belt 51.

After a transfer process is completed at each of the transfer portions Na to Nd, the recording material P is separated from the transfer belt 51 by receiving a separation bias from a separation neutralization member 65, and conveyed to a fixing unit 7.

Toner (cover toner outside image area) remaining on the transfer belt 51 after the transfer process is removed by a transfer belt cleaner 59 and collected.

Similar to the intermediate transfer belt 51, the transfer belt 51 can be made of a dielectric resin such as PC, PET or PVDF. In the present exemplary embodiment, a belt made of a carbon-dispersed PI resin having surface resistivity $10^{14}\Omega/\square$ (using JIS-K6911 compatible probe, applied voltage 1000 V, application time 60 seconds, 23° C./50% RH) and a thickness of 80 μm is used. However, conditions of the intermediate transfer belt 51 are not limited to the above, and other materials, volume resistivity, and thickness may be used.

In the present exemplary embodiment, a configuration of the transfer roller 51 is similar to that of the primary transfer roller 53. That is, the transfer roller 53 includes a core metal of an outer diameter 8 mm, and a conductive urethane sponge layer of a thickness 4 mm. An electric resistance value of the transfer roller 53 is about $10^{6.5}\Omega$ (23° C./50% RH). The electric resistance value of the transfer roller 53 is calculated from an electric current measured by rotating the transfer roller 53 abutting on a metal roller electrically grounded under a load of 500 g at a circumferential speed of 50 mm/second and applying a voltage of 100 V to the core metal.

The image forming apparatus of the present exemplary embodiment has a full-color mode and a black single color mode, and the transfer belt abuts on or separated from the photosensitive drum according to the mode. In the full-color mode, the transfer belt 51 of FIG. 8 is disposed in a position indicated by a broken line to form transfer nips between the photosensitive drums 1*a* to 1*d*, and four-color images are sequentially transferred to the conveyed recording material P. When the transfer belt 51 is disposed in this position, the drive roller 55*a* is set in a position indicated by a broken line by a motor M2. The drive roller 55*a* receives a driving force from a motor M1 to be rotated.

When the image forming apparatus of the present exemplary embodiment is in the black single color mode, as indicated by a sold line in the drawing, the transfer belt 51 comes into contact with only the photosensitive drum 1*d* to form the transfer nip, and a black single color image is transferred to the conveyed recording material P. In this case, to press down the transfer belt 51, the drive roller 55*a* is lowered to a position indicated by a solid line in the drawing. Since an attracting position of the recording material P on the transfer belt 51 is lowered, a guide member for guiding the attraction roller 84 and the recording material P to the transfer belt 51 is moved.

In the present exemplary embodiment, the circumferential speeds of the photosensitive drums are controlled based on the same idea as that of the first exemplary embodiment. That is, the circumferential speeds of the photosensitive drums are controlled by switching rotational speeds of the motors M3 to M6 that apply driving forces to the photosensitive drums. In other words, when the mode is switched to the black single color mode, it is desirable to perform separation when the circumferential speed difference between the photosensitive drums 1*a* to 1*c* and the transfer belt 51 is minimized. In the present exemplary embodiment, the circumferential speed difference between the image bearing member and the belt member before starting a separation operation is reduced more than that during an image forming operation. Conversely, when the mode is switched to the full-color mode, in the present exemplary embodiment, the circumferential speed difference between the image bearing member and the belt member before starting an abutment operation is reduced more than that during the image forming operation. More specifically, first, the photosensitive drums 1*a* to 1*c* are driven such that the circumferential speed difference with respect to a rotational speed of the transfer belt 51 can be smaller than that during the image forming operation before the transfer belt 51 abuts on the photosensitive drums 1*a* to 1*c*. Then, after attachment of the transfer belt 51 to the photosensitive drums 1*a* to 1*c*, the circumferential speeds of the photosensitive drums are gradually increased to the setting values at the time of forming an image.

Also, in the present exemplary embodiment, as described above, it is desirable to differentiate timing for changing the circumferential speed of the photosensitive drum for each photosensitive drum, or to gradually change the speed.

As described above, the present exemplary embodiment can prevent generation of a banding image in the imaging unit and the transfer portion of the black photosensitive drum caused by attachment and separation shocks of the transfer belt during switching between the full-color mode and the black single color mode.

In the present exemplary embodiment, the operation in the black single color mode in the apparatus for forming four-color images of yellow, magenta, cyan and black is described in detail. This configuration can be applied to an image forming apparatus which uses colors other than the above described four colors, and an image forming apparatus which uses hypochromic toner.

The present exemplary embodiment employs the configuration where the belt member is separated from the image bearing member. However, the present exemplary embodiment may employ a configuration where the image bearing member is separated from the belt member.

According to the present exemplary embodiment of the present invention, when one image bearing member rotates in contact with the belt member, shocks on the belt member generated by moving the image bearing member can be reduced by rotating the image bearing member at a predetermined circumferential speed difference between the belt member and the image bearing member during image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-113903 filed Apr. 24, 2008, which is hereby incorporated by reference herein in its entirety.

What is claimed is:

1. An image forming apparatus comprising:

a first rotatable image bearing member configured to bear a toner image;

a second rotatable image bearing member configured to bear a toner image;

a rotatable belt member which can abut on the first and second image bearing members;

a drive mechanism configured to attach or separate the second image bearing member to or from the belt member;

a first driving source configured to rotate and drive the first rotatable image bearing member;

a second driving source configured to rotate and drive the second image bearing member;

a belt driving source configured to rotate and drive the rotatable belt member;

an execution unit configured to execute a first image forming mode in which an image is formed in a state where the first rotatable image bearing member is in contact with the rotatable belt member with a predetermined speed difference and the second rotatable image bearing member is in contact with the rotatable belt member with the predetermined speed difference and a second image forming mode in which an image is formed in a state where the first rotatable image bearing member is in contact with the rotatable belt member with the predetermined speed difference and the second rotatable image bearing member is separated from the rotatable belt member; and a control unit configured to control speeds so that a speed difference between the second rotatable image bearing member and the rotatable belt member is smaller than the predetermined speed difference, while forming an image by using the first rotatable image bearing member in a state where the first rotatable image bearing member is in contact with the rotatable belt member with the predetermined speed difference, when one of the first mode and the second mode is changed to the other mode.

2. The image forming apparatus according to claim 1, wherein before the second image bearing member abuts on or separates from the belt member, the controller controls the rotational speed of the second image bearing member so that the rotational speed is equal to that of the belt member.

3. The image forming apparatus according to claim 1, further comprising a third image bearing member which is positioned on an upstream side of the second image bearing member in a rotational direction of the belt member and which bears a toner image, wherein when the third image bearing member abuts on or separates from the belt member, the controller controls a rotational speed of the third image bearing member so that a circumferential speed difference between the rotational speeds of the third image bearing member and the belt member is smaller than a circumferential speed difference during image formation, and when the second and third image bearing members abut on or separate from the belt member, the controller controls the rotational speeds of the second bearing member and the third image bearing member so that the rotational speed of the third image bearing member is changed prior to change of the rotational speed of the second image bearing member.

4. The image forming apparatus according to claim 1, wherein the drive mechanism attaches or separates the second image bearing member to or from the belt member when the first image bearing member abuts on the belt member while rotating.

5. The image forming apparatus according to claim 1, wherein, in a case where the first image forming mode is changed to the second image forming mode, the control unit controls the second driving source so that the speed difference between the second rotatable image bearing member and the rotatable belt member becomes smaller before the second rotatable image bearing member is separated from the rotatable belt member.

6. The image forming apparatus according to claim 1, wherein, in a case where the second image forming mode is changed to the first image forming mode, the control unit controls the second driving source so that the speed difference between the second rotatable image bearing member and the rotatable belt member becomes smaller before the second rotatable image bearing member comes into contact with the rotatable belt member.

7. The image forming apparatus according to claim 1, further comprising:

a third rotatable image bearing member that comes into contact with the rotatable belt member with the predetermined speed difference in the first image forming mode and is separated from the rotatable belt member in the second image forming mode, wherein the control unit controls speeds so that a speed difference between the third rotatable image bearing member and the rotatable belt member is smaller than the predetermined speed difference, in a case where one of the first image forming mode and the second image forming mode is changed to the other mode.

8. The image forming apparatus according to claim 7, wherein timing when the speed difference between the second rotatable image bearing member and the rotatable belt member becomes smaller is different from timing when the speed difference between the third rotatable image bearing member and the rotatable belt member becomes smaller, in a case where one of the first image forming mode and the second image forming mode is changed to the other mode.

* * * * *